US005764207A

United States Patent [19]

Maekawa et al.

[11] Patent Number: 5,764,207

[45] Date of Patent: Jun. 9, 1998

[54] ACTIVE MATRIX DISPLAY DEVICE AND ITS DRIVING METHOD

[75] Inventors: Toshikazu Maekawa; Katsuhide Uchino, both of Kanagawa, Japan

[73] Assignee: Sony Corporation, Japan

[21] Appl. No.: 423,862

[22] Filed: Apr. 18, 1995

[30] Foreign Application Priority Data

Apr. 22, 1994 [JP] Japan ..... 6-107599

[51] Int. Cl.[6] ..... G09G 3/36

[52] U.S. Cl. ..... 345/99; 345/94; 345/100

[58] Field of Search ..... 345/103, 100, 345/3, 78, 91, 94, 99, 137

[56] References Cited

U.S. PATENT DOCUMENTS

| | | | |
|---|---|---|---|
| 4,652,872 | 3/1987 | Fujita | 345/78 |
| 4,656,507 | 4/1987 | Greaves et al. | 345/137 |
| 4,860,246 | 8/1989 | Inoue | 345/3 |
| 5,166,671 | 11/1992 | Maekawa . | |
| 5,252,957 | 10/1993 | Itakura . | |
| 5,365,284 | 11/1994 | Matsumoto et al. | 345/100 |
| 5,379,050 | 1/1995 | Annis et al. | 345/91 |
| 5,426,447 | 6/1995 | Lee | 345/94 |
| 5,510,805 | 4/1996 | Lee | 345/99 |
| 5,510,807 | 4/1996 | Lee et al. | 345/103 |

FOREIGN PATENT DOCUMENTS

| | | |
|---|---|---|
| 2507366 | 12/1982 | France . |
| 2843801 A1 | 4/1979 | Germany . |
| 3511886 A1 | 10/1985 | Germany . |
| 2204718 | 8/1990 | Japan . |
| 2081018 | 2/1981 | United Kingdom . |
| WO 92/07351 | 4/1992 | WIPO . |
| 9410676 | 5/1994 | WIPO . |

OTHER PUBLICATIONS

Saitoh, Sei, et al., "Present Status and Future of Drive LSI", 443b Electronics and Communications in Japan, Part II: Electronics, 76(1993) Dec., No. 12, New York, US.

*Primary Examiner*—Richard Hjerpe
*Assistant Examiner*—Ricardo Osorio
*Attorney, Agent, or Firm*—Ronald P. Kananen

[57] ABSTRACT

To restrict a potential oscillation in a video line caused by a high speed sampling rate, the active matrix display device is comprised of gate lines X in row, signal lines Y in column and liquid crystal pixels LC of matrix arranged at each of the crossing points of both lines. The V driver 1 scans in sequence each of the gate lines X and selects the liquid crystal pixels LC in one line for every one horizontal period. The H driver 4 performs a sampling of the video signal VSIG for each of the signal lines Y and performs a writing of the video signal VSIG in the liquid crystal pixels LC in one selected line within one horizontal period. The precharging means 5 supplies the predetermined precharging signal VPS to each of the signal lines Y just before writing the video signal VSIG for the liquid crystal pixels LC in one line. With such an arrangement as above, it is possible to reduce the charging or discharging amount in each of the signal lines Y when the video signal VSIG is sampled and further to restrict the potential oscillation in the video line 2.

10 Claims, 7 Drawing Sheets

ACTIVE MATRIX DISPLAY DEVICE AND ITS DRIVING METHOD

BACKGROUND OF THE INVENTION

1. Field of the Invention

This invention relates to an active matrix display device and its driving method. More particularly, this invention relates to a potential oscillation restricting technology in a video line accompanied with a high-speed scanning of signal lines.

2. Description of Related Art

Referring now to FIG. 7, a configuration of the prior art active matrix display device will be described in brief. As shown, the active matrix display device is comprised of gate lines X of row and signal lines Y of column. Pixels of matrix are arranged at each of crossing points of both lines. Each of the pixels is comprised of liquid crystal cells LC and thin film transistors Tr for driving the cells, for example. In addition, this device has a V driver (a vertical scanning circuit) 101, each of the gate lines X is scanned in sequence and the pixels of one row are selected for every horizontal period. In addition, this device has a horizontal scanning circuit, video signals VSIG are sampled in respect to each of the signal lines Y and then the video signals VSIG are written into the pixels of one line selected for every one horizontal period. This horizontal scanning circuit is comprised of horizontal switches HSW arranged at an end part of each of the signal lines Y, and H drivers 102 for controlling them in sequence for their turning on or off state. Each of the signal lines Y is connected to the video line through the aforesaid horizontal switches HSW. The aforesaid video signals VSIG are supplied from the signal driver 103 to the video line. In order to control each of the horizontal switches HSW for its turning on or off in sequence, the H driver 102 outputs horizontal sampling pulses $\phi_{H1}$, $\phi_{H2}$, $\phi_{H3}$, . . . $\phi_{HN}$.

FIG. 8 expresses waveforms of sampling pulses $\phi_{H1}$, $\phi_{H2}$, and $\phi_{H3}$ outputted in sequence from the H driver 102 shown in FIG. 7. As the active matrix display device is made to be highly accurate in operation and the number of pixels is remarkably increased, the sampling rate is correspondingly made fast. As a result, a width $\tau_H$ of each of the sampling pulses is disturbed. As the sampling pulses are applied to their corresponding horizontal switches HSW, the video signals VSIG supplied from the video line are sampled at each of the signal lines Y through the conducted HSW. Since each of the signal lines Y has a predetermined capacitance, a charging or a discharging is produced at the signal lines Y in response to the successive horizontal sampling pulses, thereby a potential in the video line is oscillated. As described above, in the case that the sampling rate is made fast, a pulse width of each of the sampling pulses is disturbed, a charging or a discharging amount is not made constant and the potential in the video line is varied. Thus, there occurs a problem that this potential variation is overlapped to the video signals VSIG, some vertical stripes are produced at the displayed image and quality of image is destroyed.

In the case of the video signals in accordance with the normal NTSC standards, the sampling rate is relatively low and a next sampling pulse is decreased after stopping of the potential oscillation in the video line, so that influence of the oscillation of potential is made less. However, in the case of the HDTV driving or a double-speed NTSC driving, the sampling rate is remarkably increased and so it is difficult to make an effective restriction on the oscillation of potential in the video line. In general, the sampling pulses supplied to HSW are produced by the H driver composed of shift registers constructed by the thin film transistors (TFT). TFT has a lower mobility or has a larger disturbance in physical constants as compared with that of the normal transistor made of monolithic silicon, so that it is difficult to perform a precision control over the sampling pulses made by this circuit. In addition to this disturbance in sampling pulse width, ON resistance in HSW has a certain disturbance, so that they may provide a certain variation in charging or discharging characteristic in the signal lines. Due to this fact, the potential in the video line is oscillated, this state is overlapped on the actual video signal to cause its state to appear as vertical stripes, resulting in that quality of the displayed image is remarkably damaged.

SUMMARY OF THE INVENTION

In view of the aforesaid technical problems found in the prior art, it is an object of the present invention to perform a restriction of a potential oscillation in the video line generated as the sampling rate of the video signal is increased. In order to accomplish the aforesaid object, the present invention has provided the following means. That is, the active matrix display device of the present invention is provided with gate lines in row, signal lines in column and matrix pixels arranged at each of the crossing points of both lines as its basic configuration. In addition, there are also provided a vertical scanning circuit in which each of the gate lines is scanned in sequence and pixels in one line are selected for every one horizontal period, and a horizontal scanning circuit in which the video signals are sampled at each of the signal lines and the video signals are written on the video signals in one line selected within one horizontal period. As a feature of the present invention, there is provided a precharging means and the predetermined precharging signals are supplied to each of the signal lines just prior to the writing of the video signals in respect to the pixels in one line.

The precharging means supplies a precharging signal having a grey level in respect to the video signal varying between the white level and the black level. Alternatively, in the case that an AC reverse driving is to be carried out, the precharging means supplies the precharging signal similarly reversed for every one horizontal period in order to cause its polarity to be coincided with the video signal reversed for every one horizontal period.

In accordance with one preferred embodiment of the present invention, the precharging means is separately arranged from the horizontal scanning circuit and is comprised of a plurality of switching elements connected to an end part of each of the signal lines, and a control means for totally turning on or off each of the switching elements and applying a precharging signal to each of the signal lines. In accordance with another preferred embodiment of the present invention, the precharging means is arranged in integral with the horizontal scanning circuit and is comprised a plurality of switching elements connected to an end part of each of the signal lines, and a control means for turning on or off in sequence each of switching elements during writing operation, sampling the video signals to the corresponding signal line and in turn totally turning on or off each of the switching elements just before writing and applying the precharging signal included in the video signal to each of the signal lines.

The present invention includes a method for driving the active matrix display device. This driving method performs a vertical scanning for scanning in sequence each of the gate lines and selecting pixels in one line for every one horizontal period, a horizontal scanning for sampling in sequence the video signals in respect to each of the signal lines and writing the video signals into the pixels in one line selected within one horizontal period, and a precharging for totally supplying the predetermined precharging signals to each of the signal lines just before writing the video signals to the pixels in one line.

According to the present invention, all the signal lines are precharged in advance up to a potential near the video signals at a timing not influencing the displaying operation. With such an arrangement as above, a charging or discharging amount when the actual video signals are sampled at each of the signal lines is reduced and a potential oscillation at the video line is restricted.

DESCRIPTION OF THE PREFERRED EMBODIMENT

Figure 1:
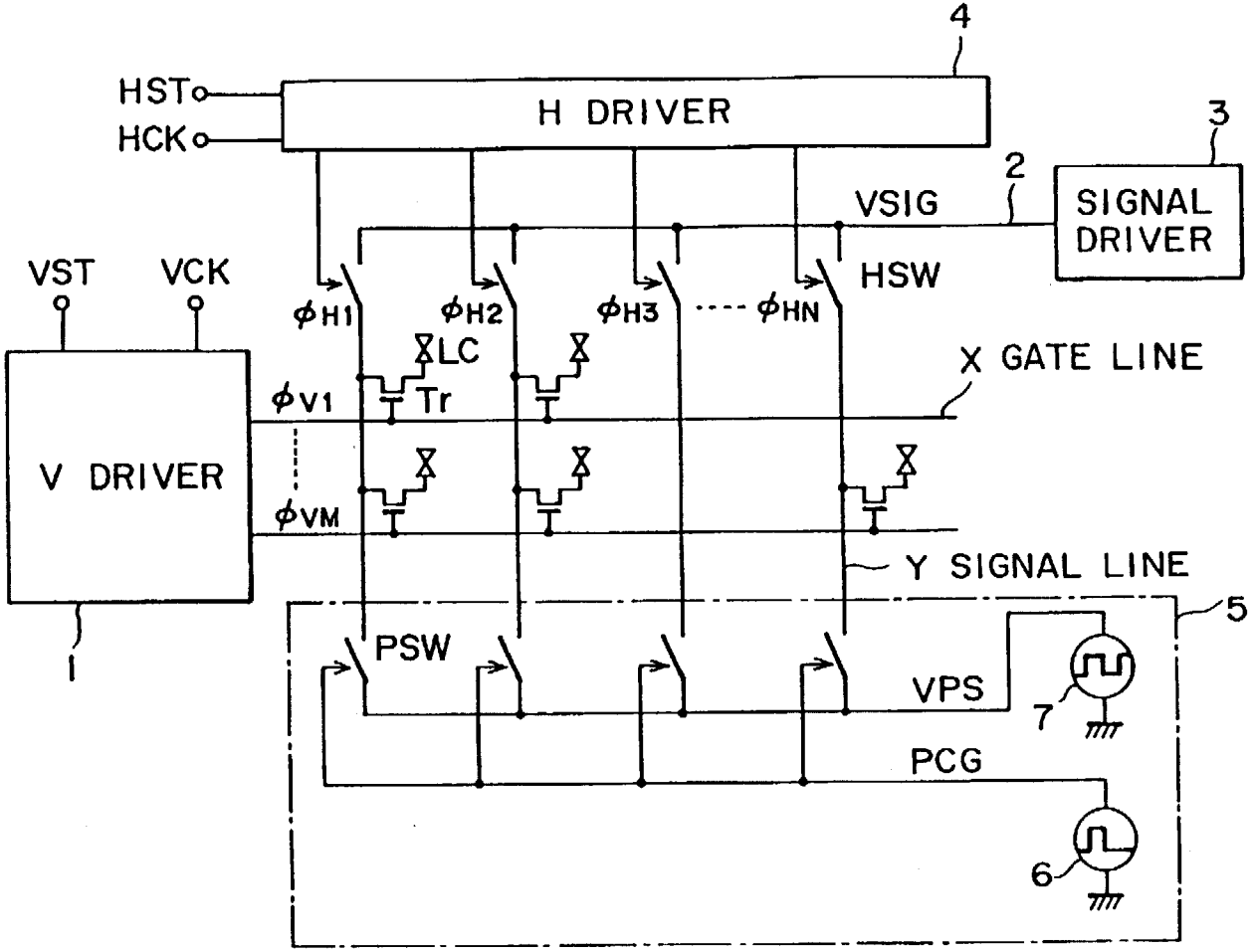
FIG. 1 is a circuit diagram for showing the first preferred embodiment of the active matrix display device of the present invention.

Referring now to the drawings, the preferred embodiments of the present invention will be described in detail. FIG. 1 is a schematic circuit diagram for showing the first preferred embodiment of the active matrix display device of the present invention. As shown in the figure, the active matrix display device is comprised of gate lines X in row and signal lines Y in column arranged in matrix. There are provided liquid crystal pixels LC arranged at each of the crossing points of the gate lines X and the signal lines Y. Although the active matrix display device of the present preferred embodiment is provided with some liquid crystal pixels, it is of course apparent that it may be provided with other pixels of electro-optical substances. The liquid crystal pixels LC are driven by the thin film transistors Tr. Source electrodes of the thin film transistors Tr are connected to the corresponding signal lines Y, gate electrodes are connected to the corresponding gate lines X and drain electrodes are connected to the corresponding liquid crystal pixels LC.

V driver 1 is connected to each of the gate lines X so as to constitute the vertical scanning circuit. This V driver 1 transfers the vertical start signals VST in sequence in response to a predetermined clock signal VCK and supplies the successive row selection pulses $\phi_{V1}, \ldots \phi_{VM}$ to each of the gate lines X. With such an arrangement as above, each of the gate lines X is scanned in sequence and the liquid crystal pixels LC in one line are selected for every one horizontal period.

In turn, the respective signal line Y is connected to the video line 2 through the corresponding horizontal switching elements HSW. To the video line 2 are supplied the video signals VSIG from the signal driver 3. In addition, there is provided an H driver 4 so as to control of turning on or off of each of the horizontal switching elements HSW. That is, the H driver 4 transfers in sequence the horizontal start signals HST in synchronous with the predetermined horizontal clock signal HCK and outputs the successive sampling pulses $\phi_{H1}, \phi_{H2}, \phi_{H3}, \phi_{H4}, \ldots \phi_{HN}$ so as to turn on or off the horizontal switching elements HSW during each horizontal scanning period. The horizontal scanning circuit is constituted by the H driver 4 and the horizontal switching elements HSW, the video signals VSIG are sampled in respect to each of the signal lines Y, and the video signals VSIG are written through the thin film transistors Tr kept conductive in respect to the pixels LC in one line selected within one horizontal period.

As a feature of the present invention, there is provided a precharging means 5, a predetermined precharging signal VPS is supplied to each of the signal lines Y just prior to writing of the video signals VSIG in the liquid crystal pixels LC in one line, and then a charging or a discharging amount of each of the signal lines Y generated when the video signals VSIG are sampled is reduced. In the preferred embodiment above, the precharging means 5 is separately arranged from the aforesaid horizontal scanning circuit, and is comprised of a plurality of switching elements PSW connected to the end part of each of the signal lines Y, and a control means 6 for totally turning on or off of each of the switching elements PSW and applying the precharging signals VPS to each of the signal lines Y. In the preferred embodiment, this control means 6 outputs a control pulse PCG. In addition, the precharging signal VPS is supplied from the signal source 7 separately arranged from the signal driver 3. This precharging signal VPS has a grey level in respect to the video signals VSIG varying between the white level and the black level. In the preferred embodiment, although the horizontal switching elements HSW and the additional switching elements PSW are arranged at both ends of the signal lines Y, the present invention is not limited to this arrangement, but PSW may be arranged at the same side of HSW.

Figure 2:
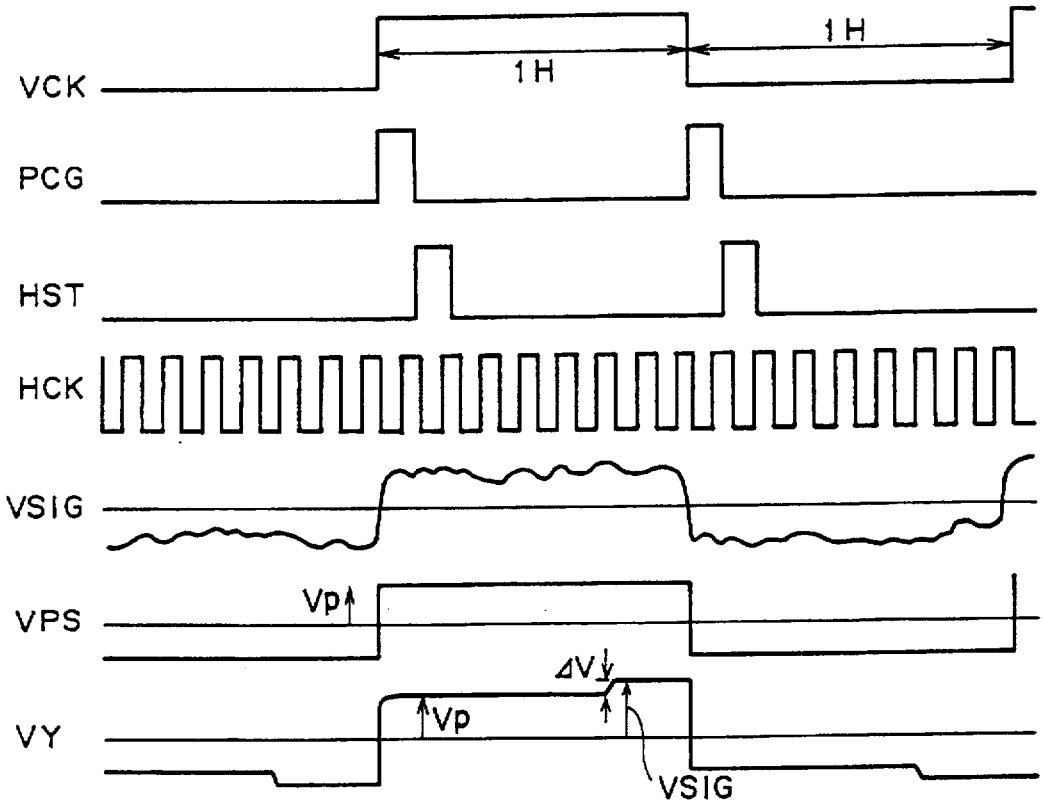
FIG. 2 is a timing chart applied for illustrating an operation in the first preferred embodiment.

Then, referring to FIG. 2 of timing chart, operation of the active matrix display device shown in FIG. 1 will be described in detail. The vertical clock signal VCK inputted to the V driver 1 has a pulse width corresponding to one horizontal period (1H). In addition, the control pulse PCG outputted from the control means 6 is outputted within a horizontal non-effective period such as a horizontal blanking period, for example. If the control pulse PCG overlaps the horizontal effective period, there is a possibility that the precharging signals VPS are written into the liquid crystal pixels. In addition, when the selection pulses $\phi_V$ outputted in sequence from the V driver 1 shown in FIG. 1 are overlapped and the control pulse PCG is outputted during that period, the precharging signal VPS is similarly apt to be written into the liquid crystal pixels and so it is necessary to prevent this phenomenon. Then, the horizontal start pulses HST supplied to the H driver 4 are outputted just after the selection pulses PCG for every one horizontal period, and then the sampling of the video signals VSIG is started. This sampling is carried out in sequence in synchronous with the horizontal clock signal HCK supplied to the H driver 4.

The video signal VSIG supplied from the signal driver 3 through the video line 2 has a reverse polarity for every one horizontal period and then an AC driving is carried out. In response to this operation, the precharging signals VPS supplied from the signal source 7 are also reversed for every one horizontal period and has its polarity coincided with that of the video signals VSIG. The precharging signal VPS has a potential level of $V_P$ in respect to a central potential of the video signal VSIG and just expresses a grey level positioned between the white level and the black level. In this way, the potential level of the precharging signal VPS in the preferred embodiment is basically set to a grey level in which its uniformity can be most visually discriminated. The last waveform in the timing chart of FIG. 2 expresses the potential VY applied to respective signal line Y. When the control signal PCG is outputted at the initial stage of one horizontal period and an additional switching element PSW is made conductive, the precharging signals VPS are applied to all the signal lines Y and then the charging or discharging is carried out for a capacitance component. Applying of this precharging signal VPS causes the potential VY in each of the signal lines Y to become a level of $V_P$. After this operation, the actual video signal VSIG is sampled in respect to each of the signal lines Y, its potential VY is changed in response to VSIG and its writing is carried out. A potential variation $\Delta V$ caused by the writing operation is reduced to $VSIG-V_P$ and then the charging or discharging amount is reduced. As described above, the present invention employs a constitution in which all the signal lines Y are precharged in advance up to a potential of middle level at a timing such as the horizontal blanking period not applying any influence to the displayed video, the charging or discharging current in the signal line generated when the actual video signal VSIG is sampled and then a potential oscillation in the video line 2 is restricted. In other words, the charging or discharging of each of the signal lines Y is almost finished through the additional switching element PSW, and the charging or discharging with the actual video signal VSIG is produced only with a difference in potential level of the precharging signal VPS and the video signal VSIG.

Figure 3:
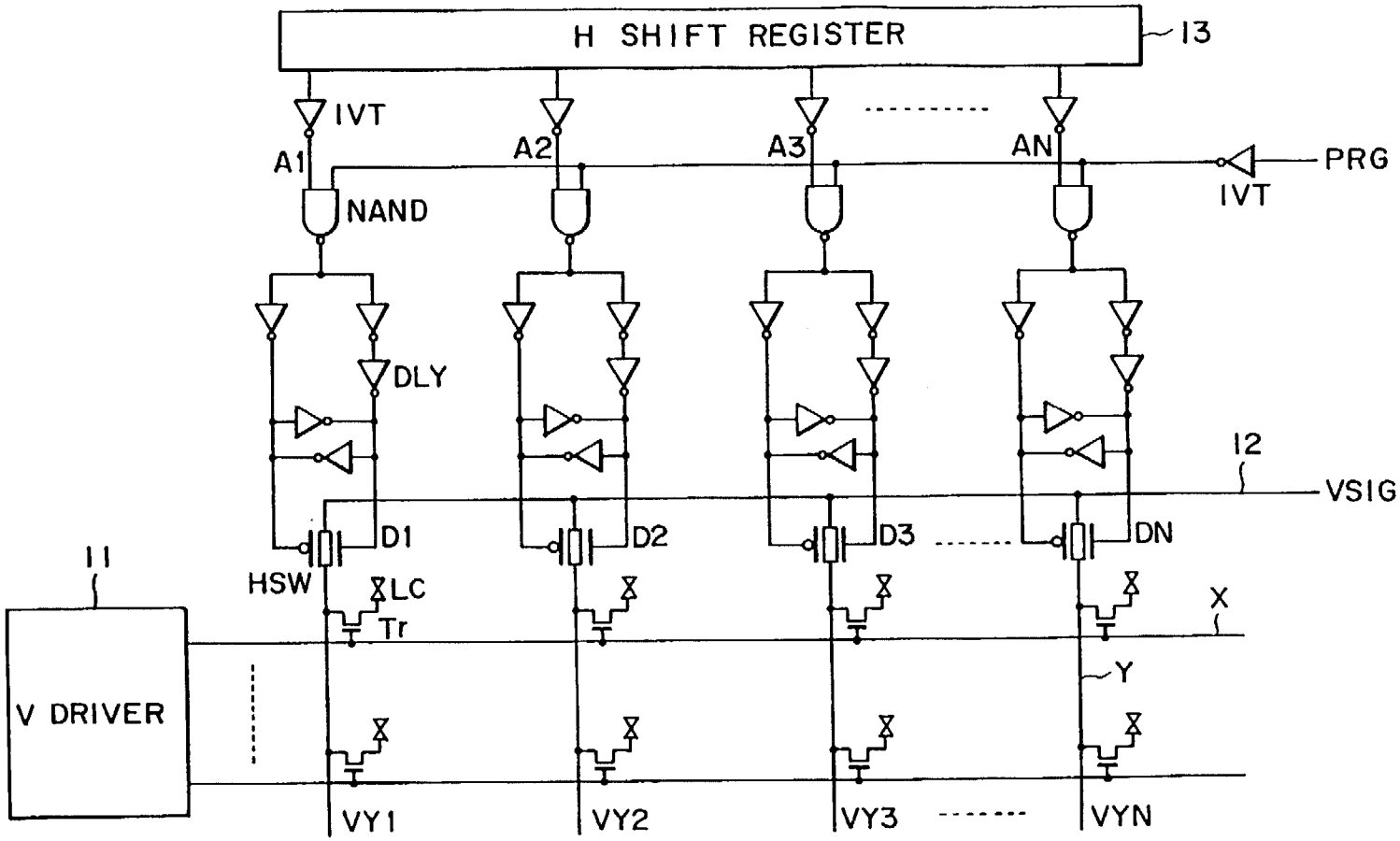
FIG. 3 is a circuit diagram for showing the second preferred embodiment of the active matrix display device of the present invention.

FIG. 3 is a circuit diagram for showing the second preferred embodiment of the active matrix display device of the present invention. Each of the crossing points between the gate lines X and the signal lines Y is provided with the liquid crystal pixels LC and the thin film transistors Tr for driving the pixels. To each of the gate lines X are connected the V drivers 11 so as to constitute the vertical scanning circuit.

In turn, each of the signal lines Y is connected to the video lines 12 through the horizontal switching elements HSW comprised of transmission gates. To the video lines 12 are supplied the video signals Vsig. The video signals Vsig are processed in such a manner that they include a part of the precharging signal at a pre-processing stage. To each of the horizontal switching elements HSW are connected NAND gates through the delay circuit DLY composed of a combination of five inverters. To one input terminal of each of NAND gates is applied a signal A outputted from each of the stages of the H shift register 13. To the other input terminal of NAND gate is applied a blanking signal PRG through the inverter IVT. The horizontal scanning circuit is comprised of the H shift register 13, NAND gate, delay circuit DLY and horizontal switching element HSW and the like.

In the preferred embodiment, the precharging means is integrally arranged with the horizontal scanning circuit, wherein the horizontal switching elements HSW connected to the end part of each of the signal lines Y are utilized. In addition, NAND gates are used as control means, each of the switching elements HSW is turned on or off in sequence during writing operation, the video signals Vsig are sampled in the corresponding signal lines Y and in turn each of the switching elements HSW is totally turned on or off just before writing operation so as to apply the precharging signal contained in a part of the video signal Vsig to each of the signal lines Y.

In the preferred embodiment of the present invention, the vertical scanning circuit for scanning the gate lines linearly in sequence and selecting pixels in one row for every horizontal period has been employed, although another vertical scanning circuit for selecting more than two rows concurrently may be applied. In addition, a point sequential process in which video signals are supplied in sequence to each of the signal lines through the horizontal switching elements has been described, although this process can be applied to another system in which the video signals are written by line-at-a-time scanning into the signal lines.

Figure 4:
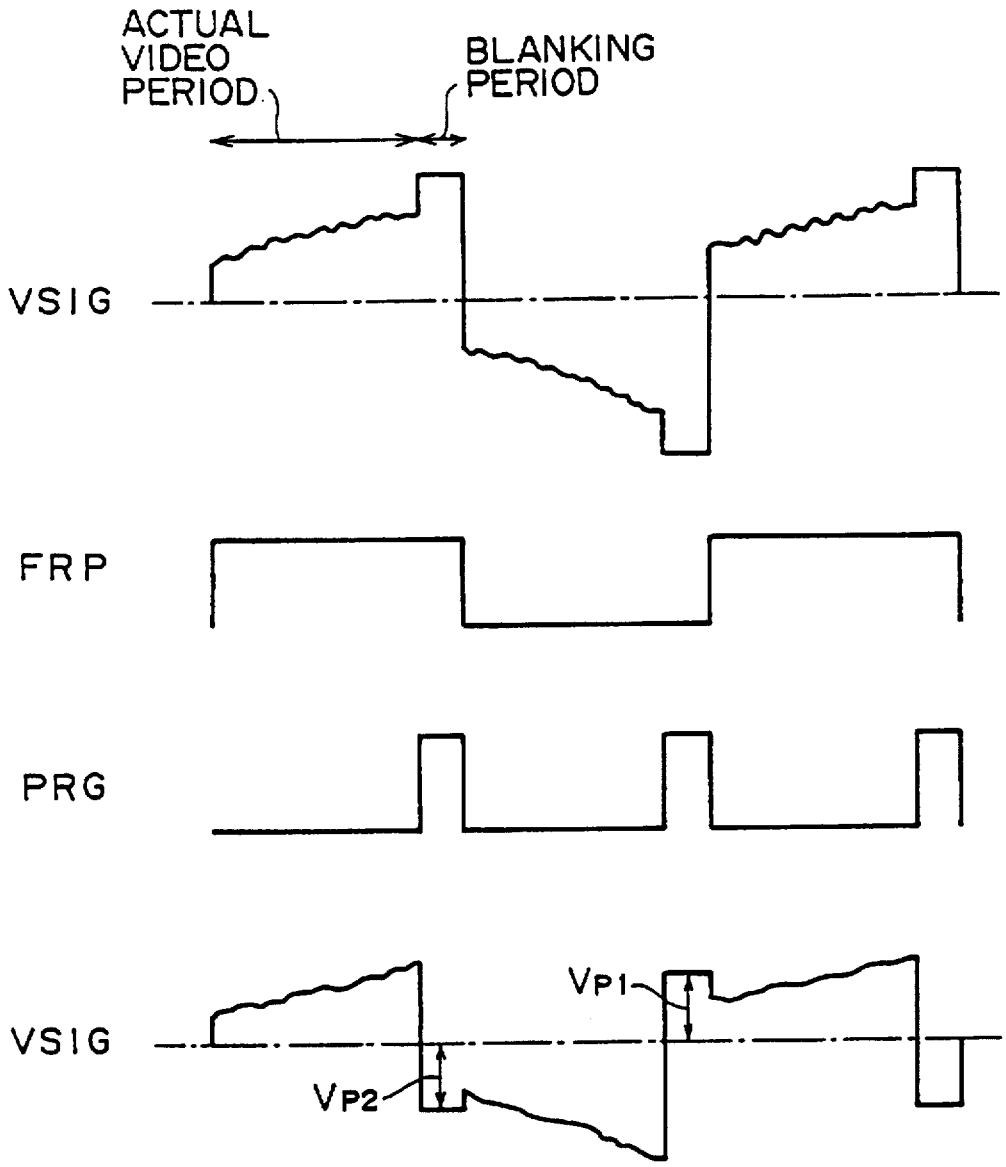
FIG. 4 is a timing chart applied for illustrating an operation of the second preferred embodiment.

Before starting description of the operation of the active matrix display device shown in FIG. 3, referring now to FIG. 4, a pre-processing of the video signals will be described. As shown, the original video signals VSIG are divided into the actual video period and the blanking period for every one horizontal period. The video signals VSIG reversed in synchronous with the reversing signals FRP for every one horizontal period. The video signals VSIG are processed in synchronous with the blanking signals PRG and then the precharging signals having predetermined potential levels $V_{P1}$ and $V_{P2}$ are inserted within the blanking period. The synthesized video signal Vsig in this way is indicated at the lowest stage in the timing chart of FIG. 4.

Figure 5:
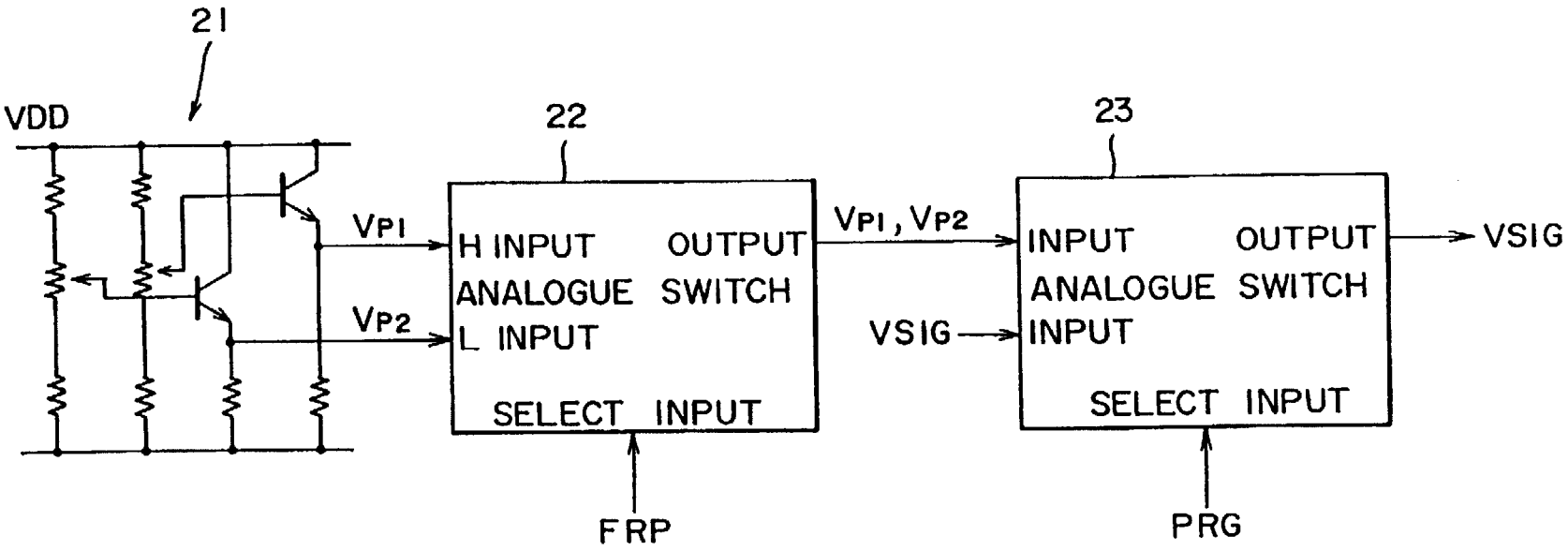
FIG. 5 is a block diagram for showing one example of a synthesizing circuit of video signals used in the second preferred embodiment.

Referring now to FIG. 5, one example of a circuit configuration for performing a pre-processing of the video signals. As shown in this figure, this circuit has a resistor dividing part 21, wherein a power supply voltage Vdd-Vss is divided by resistance value to produce two kinds of voltage levels $V_{P1}$ and $V_{P2}$. One voltage level $V_{P1}$ is supplied to an H input of the analog switch 22, the other voltage level $V_{P2}$ is supplied to an L input. This analog switch 22 applies the reversed signal FRP as a selection input, selects $V_{P1}$ and $V_{P2}$ alternatively for every one horizontal period and outputs it. The values $V_{P1}$, $V_{P2}$ selected in this way are supplied to one input of the next stage analog switch 23. To the other input of the analog switch 23 are supplied the original video signals VSIG. The analog switch 23 alternatively inserts $V_{P1}$, $V_{P2}$ for every one horizontal period within the blanking period with the blanking signal PRG being applied as a select input and then outputs the synthesized video signal Vsig.

Lastly, referring now to FIG. 6, an operation of the active matrix display device shown in FIG. 3 will be described in detail. As illustrated in this figure, the synthesized video signal Vsig has alternatively the voltage levels $V_{P1}$, $V_{P2}$ for every one horizontal period within the blanking period and shows a waveform including the precharging signal.

The H shift register 13 shown in FIG. 3 outputs the sampling pulses A1, A2, A3, . . . AN for every stage through the inverter IVT. In addition, NAND gates arranged for each stage make the drive pulses D1, D2, D3, . . . DN in reference to the sampling pulse and the blanking signal PRG. The drive pulses are similarly supplied to the corresponding switching element HSW through the delay circuit DLY arranged for each stage so as to drive to turn it on or turn it off.

Figure 6:
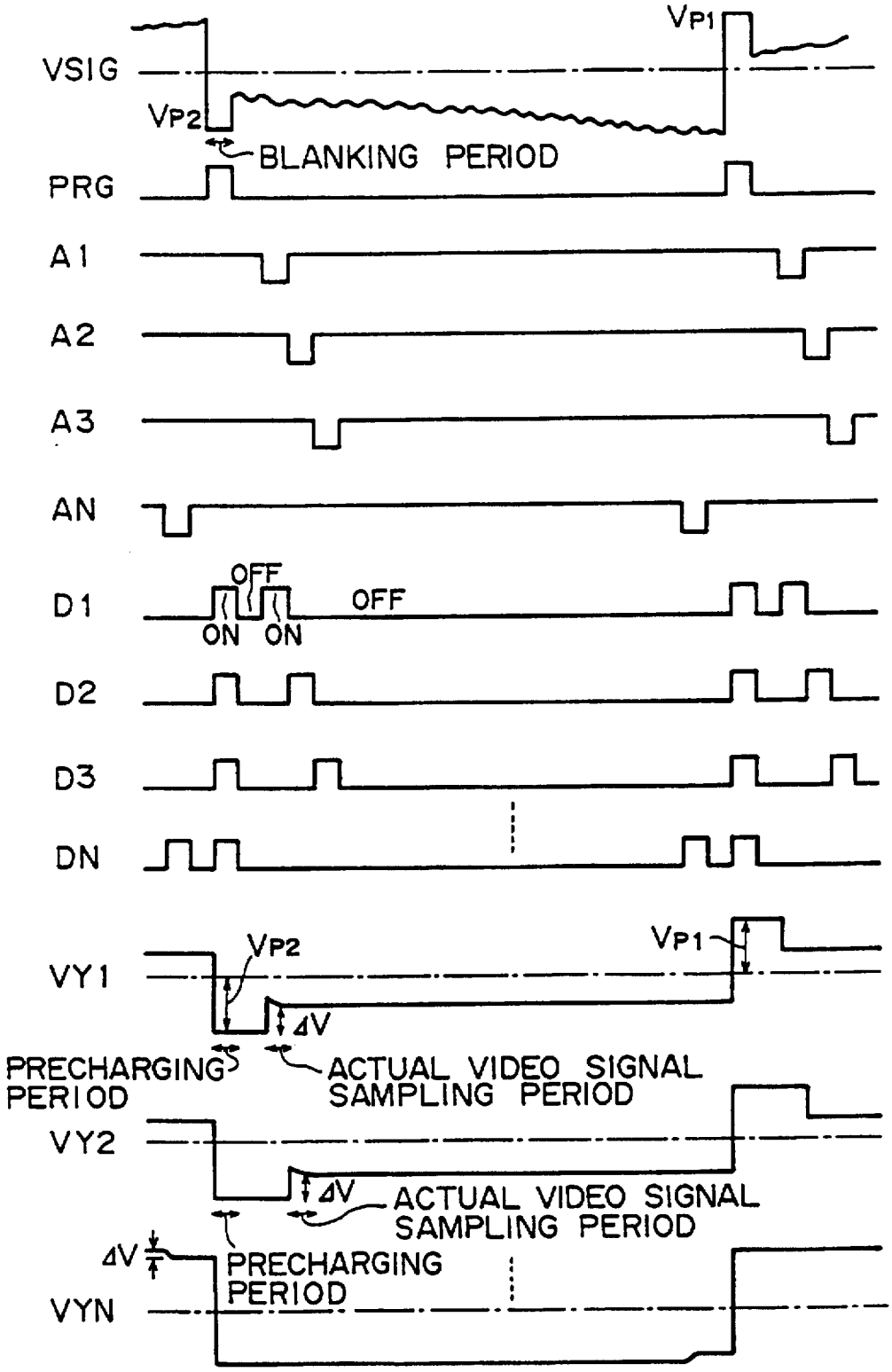
FIG. 6 is also a timing chart to be applied for illustrating an operation in the second preferred embodiment.
Figure 7:
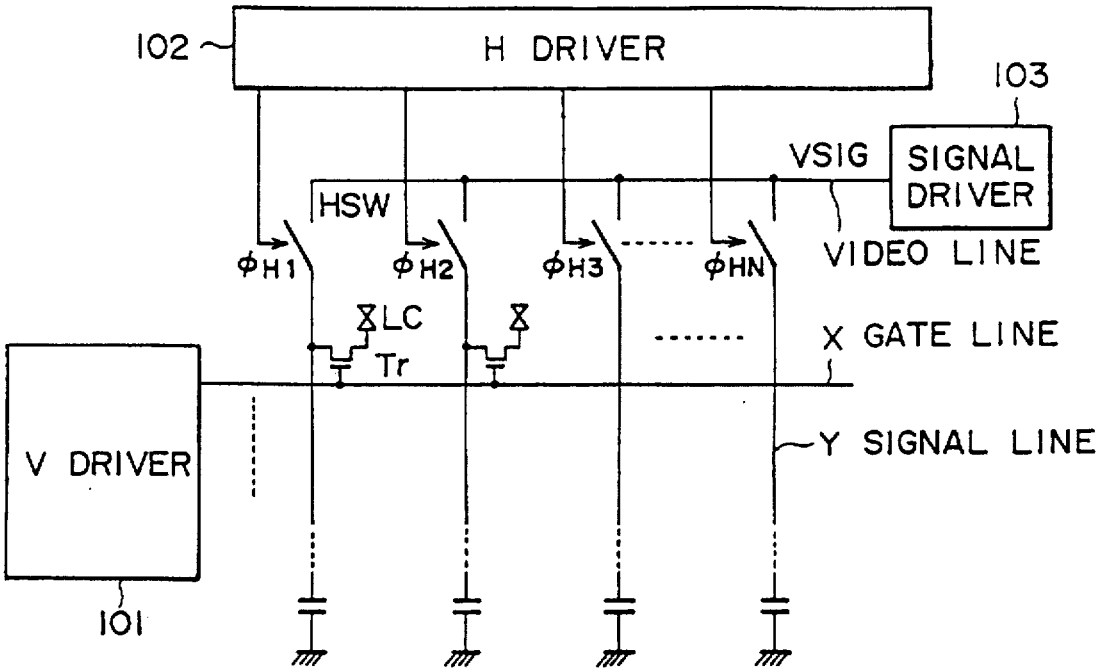
FIG. 7 is a block diagram for showing one example of the prior art active matrix display device.
Figure 8:
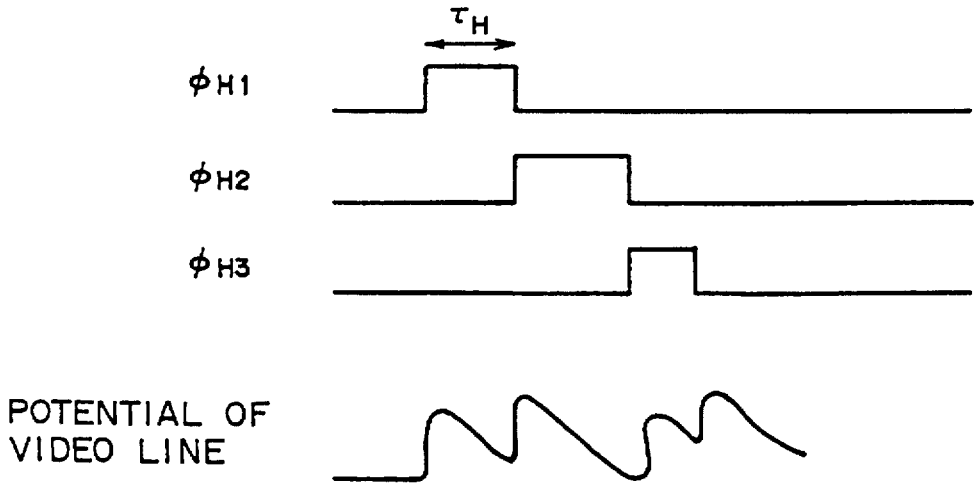
FIG. 8 is a waveform figure to be applied for illustrating the problem in the prior art active matrix display device.

As indicated in the timing chart of FIG. 6, the drive pulses D1, D2, D3, . . . DN have leading pulses which are synchronous with the blanking period. With such an arrangement as above, each of the horizontal switching elements HSW is totally turned on or off and the potential level $V_{P2}$ or $V_{P1}$ of the precharging signal included in the synthetic video signal Vsig is applied to each of the signal lines. Accordingly, the potentials VY1, VY2, . . . VYN in each of the signal lines are once charged to the level of $V_{P2}$. In addition, at the leading end of the next horizontal period, it is charged to the potential level $V_{P1}$ of the opposite polarity. After elapsing this blanking period, each of the drive pulses D1, D2, D3, . . . DN controls again in sequence to turn on or turn off HSW and performs a sampling of the actual video signals. In this way, all HSWs are once made conductive within the blanking period, precharging signal levels ($V_{P1}$, $V_{P2}$) are written in each of the signal lines Y and held just before the actual video signals are written. That is, almost of the charging or discharging in each of the signal lines Y within the blanking period is finished and the charging or discharging when the actual video signals are sampled is operated only for the difference ΔV between the precharging signal level and the actual video signal level. With this operation above, a potential oscillation (noise) in the video line is restricted and it becomes possible to remove the fixed pattern of the vertical stripes.

As described above, according to the present invention, the charging or discharging amount at each of the signal lines is reduced when the video signals are sampled by supplying the predetermined precharging signal to each of the signal lines just before writing the video signals for the pixels in one line. With such an operation as above, noise in the video line generated through charging or discharging of the video signals is substantially reduced, so that the present invention can obtain some effects that the fixed pattern of vertical stripes can be removed and video quality can be substantially improved. In addition, since it is not necessary to consider a slight disturbance in sampling pulse outputted from the horizontal scanning circuit, the present invention provides an effect that the circuit design margin can be reduced. Due to a similar reason, since it is possible to reduce the power supply voltage in the horizontal scanning circuit, the present invention may provide an effect that a consumption power can be reduced. In particular, the present invention may provide some effects that the precharging can be realized only through including the precharging signal in the video signals and controlling of the sampling operation in the horizontal scanning circuit and no burden in circuit design may occur.

What is claimed is:

1. An active matrix display device for displaying video signals, comprising:

a plurality of gate lines arranged in rows;

a plurality of signal lines arranged in columns and intersecting said gate lines;

a pixel at each intersection between one of said gate lines and one of said signal lines;

a vertical scanning circuit for line-at-a-time scanning of successive ones of the gate lines for selecting the pixels of each scanned row;

a video processing circuit for generating a synthesized video signal from a video signal having periodic blanking periods and a potential which varies between a dark value and a white value during periods between the periodic blanking periods, said video processing circuit inserting a predetermined precharge potential substantially coextensive with the blanking periods to provide a synthesized video signal having periodic precharge potentials and a potential varying between a dark value and a white value during periods between the periodic precharge potentials; and a horizontal scanning circuit for sequentially sampling the synthesized video signal, for applying the precharge potential of the synthesized video signal to all the signal lines during the blanking period, and for subsequently writing the sampled video signal in sequence to the pixels in the selected row.

2. An active matrix display device according to claim 1 in which said horizontal scanning circuit applies said precharging potential simultaneously for all signal lines.

3. An active matrix display device according to claim 1 in which said vertical scanning circuit supplies a precharging potential inverted for every one horizontal period in such a way that its polarity coincides with that of a video signal inverted for every one horizontal period.

4. An active matrix display according to claim 1 in which said horizontal switching circuit circuit is provided with a plurality of switching elements connected to an end part of each of the signal lines, and with a control circuit for simultaneously turning on or off each of the switching elements and applying the precharging potential to each of the signal lines.

5. An active matrix display device according to claim 4 in which said control circuit outputs a control pulse during a horizontal non-effective period.

6. An active matrix display device according to claim 5 in which said horizontal non-effective period comprises said a blanking period.

7. An active matrix display device according to claim 1 in which said video processing circuit is integrally arranged with said horizontal scanning circuit and includes a plurality of switching elements connected to an end part of each of the signal lines and a control circuit for turning on or off in sequence each of the switching elements during a writing operation, for sampling a video signal in a corresponding signal line, and, in turn, simultaneously turning on or off each of the switching elements just before the writing operation and applying the precharging potential to each of the signal lines.

8. A method for driving an active matrix display device with a video signal having periodic blanking periods and a potential varying between a dark value and a white value during a period between the periodic blanking periods, the display device having a plurality of gate lines arranged in rows, a plurality of signal lines arranged in columns intersecting the gate lines, and a pixel at each intersection between a gate line and a signal line, said method comprising:

processing a video signal to provide a synthesized video signal having a precharge potential coincident with the blanking period and a potential varying between dark and light values during a period between the precharge potentials;

selecting successive gate lines to select the pixels in the selected gate line;

sampling the synthesized video signal for each selected gate line;

applying the precharge potential to all the signal lines prior to writing the sampled synthesized video signal thereto; and writing the sampled video signal to the pixels in the selected row.

9. A method for driving an active matrix display device according to claim 8 in which said precharging potential is supplied simultaneously to said signal lines.

10. A method for driving an active matrix display device according to claim 8 in which said sampled video signal is written by dot sequential scanning.

* * * * *